US005411432A

United States Patent [19]

Wyatt et al.

[11] Patent Number: 5,411,432

[45] Date of Patent: May 2, 1995

[54] PROGRAMMABLE OSCILLATING LIQUID JET CUTTING SYSTEM

[76] Inventors: Peter Wyatt; Matthew Peterson, both of NED JET Cutting Systems Inc. 18 Grafton St., Worcester, Mass. 01604-4992

[21] Appl. No.: 972,475

[22] PCT Filed: Sep. 9, 1992

[86] PCT No.: PCT/US92/07961

§ 371 Date: Jan. 11, 1993

§ 102(e) Date: Jan. 11, 1993

[87] PCT Pub. No.: WO94/07001

PCT Pub. Date: Mar. 31, 1994

[51] Int. Cl.[6] ..... B24C 3/06

[52] U.S. Cl. ..... 451/92; 451/3; 74/25; 74/567

[58] Field of Search ..... 51/429, 426, 416; 74/25, 567; 451/92, 89, 3

[56] References Cited

U.S. PATENT DOCUMENTS 2,476,716 7/1949 Fields ..... 74/25
2,998,787 9/1961 Pollmeier ..... 74/25
4,036,437 7/1977 Dreher ..... 51/429
4,309,850 1/1982 Benson ..... 51/429
4,367,902 1/1983 Schwarting et al. ..... 299/42

*Primary Examiner*—Robert A. Rose
*Attorney, Agent, or Firm*—S. Pal Asija

[57] ABSTRACT

A high pressure computer controlled liquid jet cutting system particularly adopted for cutting granite on-site at quarries comprising a balanced oscillator, an optional mobile system, a power unit, multiple intensifiers, one or more nozzles with diamond or sapphire orifice and a microcontroller with a control panel for programming and controlling rise and fall, indexer and oscillator system. The computer controlled balanced oscillator with rise and fall in turn comprises a bent cam shaft in cam housing and a drive shaft in a drive housing. The drive shaft on one end has a pulley driven by a motor. Also included are means for adjusting the balance. A typical embodiment also includes boom leveling system for tilt, dump and swing, tilting system for chain feed to level and position in travel mode and E Chain containing extendible, flexible high pressure hose as well as means for disengaging the oscillator from the high pressure tubing without breaking any fittings for centering purposes.

5 Claims, 9 Drawing Sheets

JET PATH c
x

PROGRAMMABLE OSCILLATING LIQUID JET CUTTING SYSTEM

BACKGROUND

This invention relates to liquid jet cutting systems. More particularly it relates to high pressure water jet cutting systems adapted for cutting granite stones on-site at quarries.

TECHNICAL CHARACTER

The technical character of this invention resides in a balanced oscillator with rise and fall and means for adjusting the balance, a computer interface and a nozzle with sapphire, diamond or like substance on the orifice thereof.

PRIOR ART

A prior art search was conducted and the following pertinent U.S. prior art patents were uncovered arranged in reverse chronological order.

a) U.S. Pat. No. 4,872,293 issued to Yasukawa et al on Oct. 10, 1989 for "Abrasive Water Jet Cutting System"

b) U.S. Pat. No. 4,870,336 issued to Ellery Nickerson on Sep. 26, 1989 for "Water Jet Trim Head Simulator"

c) U.S. Pat. No. 4,836,613 issued to Roger Adam on Jun. 6, 1989 for "Cutterhead for Water Jet Assisted Cutting"

d) U.S. Pat. No. 4,698,939 issued to Mohammed Hashish on Oct. 13, 1987 for "Two Stage Waterjet Abrasive Jet Catcher"

e) U.S. Pat. No. 4,624,326 issued to Charles Loegel Jr. on Nov. 25, 1986 for "Process and Apparatus for cutting Rock"

f) U.S. Pat. No. 4,573,382 issued to Kloehn et al on Mar. 4, 1986 for "Apparatus and Method for Cutting a Web"

g) U.S. Pat. No. 4,435,902 issued to Mercer et al on Mar. 13, 1984 for "Articulated Boom Water Jet Cutting Apparatus"

h) U.S. Pat. No. 4,369,850 issued to Clark Barker on Jan. 25, 1983 for "High Pressure Fluid Jet Cutting and Drilling Apparatus"

i) U.S. Pat. No. 4,367,902 issued to Schwartling et al on Jan. 11, 1983 for "Tool for Hydromechanical or Hydraulic Mining or for Cutting Mineral or Bituminous Materials"

j) U.S. Pat. No. 4,176,883 issued to Daniel Liesveld on Dec. 4, 1979 for "Oscillating Liquid Jet System and Method for Cutting Granite and the Like"

k) U.S. Pat. No. 4,111,490 also issued to Daniel Liesveld on Sep. 5, 1978 for "Method and Apparatus for Channel Cutting of Hard Materials Using High Velocity Fluid Jets"

l) U.S. Pat. No. 4,018,623 issued to John Walker on Apr. 19, 1977 for "Method of Cutting Using A High Pressure Water Jet"

Prior art fluid jet cutting systems with an oscillator have either an unequal dwell time at each end there by rendering an uneven cut on each side or an equal dwell time at very slow speeds. Some prior art systems compensate for unequal dwell time with spring tension in a small diameter tubing which limits their application to low horse power (Q*P*N) systems where Q=Flow P=Pressure and N=a constant or a factor. Accordingly low horse power prior art systems have limited production per square feet.

Prior art systems are also limited in the length of the tubing feeding the nozzle such that they are unable to accommodate cuts of several feet in depth. Furthermore none of the prior art patents achieve the objectives neither individually nor collectively.

OBJECTIVES

1) It is an objective of this invention to provide an oscillator which has equal travel and dwell time at each end of the center, thereby providing and even cut on both faces of the item being cut.

2) Another objective of this invention is to provide a programmable interface such that the system can be reprogrammed for varied applications readily.

3) Another objective of this invention is to include a diamond sapphire or the like substance at the orifice of the nozzle.

4) Another objective of this invention is to provide multiple water jet Cutting nozzles driven and powered by the same power unit on the same crawler to increase the cut rate efficiency and cost effectiveness on-site at a quarry.

5) Another objective of this invention is to provide an environmentally friendly system.

6) Another objective of this invention is to provide a safer, quicker method of cutting stone on site at a quarry.

7) Another objective of this invention is to provide a system that is reliable and easy to maintain.

8) Another objective of this invention is to provide a system that is intuitive and easy to use such that it requires little training or retraining.

9) Another objective of this invention is to disengage the oscillator from the high pressure tubing without breaking any fittings.

10) Another objective of this invention is that the thickness of the cut, the pitch, the rise and fall speed and the jet cut path be all coordinated and computer controlled such that the operator needs to enter or reset only the minimum set of parameters for each new programmable automatic unattended cut.

11) Another objective of this invention is that the single system have multiple waterjets each capable of cutting several feet in depth.

12) Another objective of this invention is that it provide all of the above mentioned objectives concurrently in high horse power (Q*P*N), wherein Q=Flow P=Pressure N=A constant factor 13) Another objective of this invention is to provide a means for adjusting the balance of the balanced oscillator of this invention.

14) Another objective of this invention is to pretension the oscillator or high pressure tubing so as to alter the position and/or dwell of the nozzle as it moves to and fro.

15) Another objective of this invention is to maximize the productivity of the cut under various pressures and positions of the stone being cut.

16) Another objective of this invention is to permit the operator to cut the stone to the left or the right intentionally without loosening a fitting.

17) Another objective of this invention is to provide a means for readily fine tuning the shape of the cut under differing quarry conditions.

18) Other objectives of this invention reside in its simplicity, design elegance, ease of manufacture, ease of training and the like as will become apparent from the following brief description of the drawing and detailed description of the preferred and various alternate embodiments.

BRIEF DESCRIPTION OF THE DRAWINGS

The objects, features, and advantages of the present invention and its application will be more readily appreciated when read in conjunction with the accompanying drawing, in which.

a)

b)

c)

d)

f)

g)

Figure 8A:
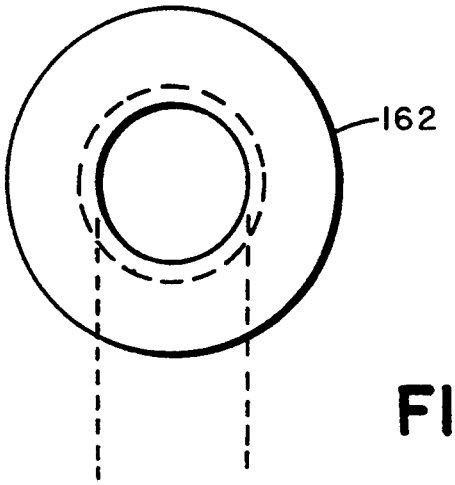
Figures 9A, 9B:
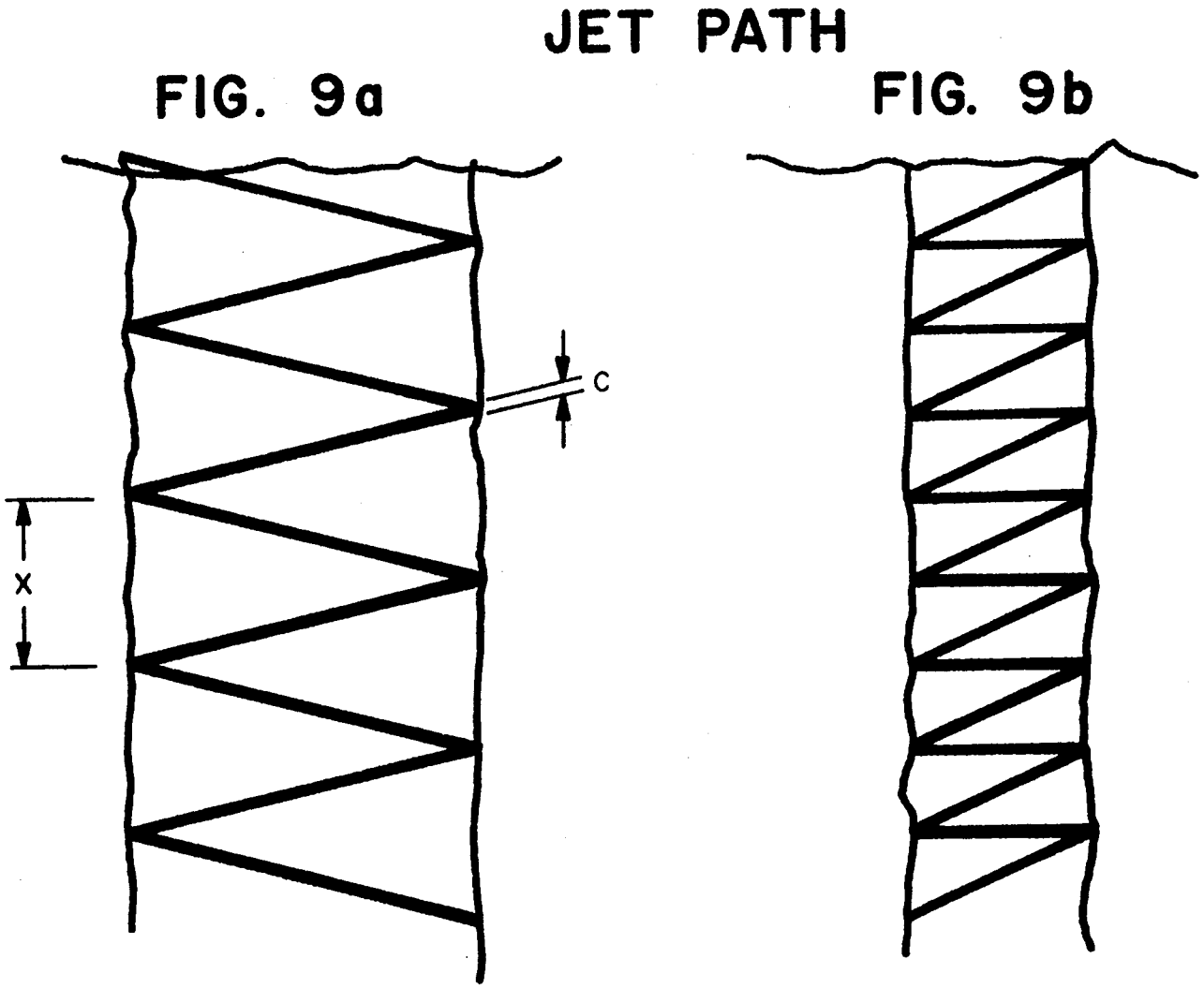
Figure 10A:
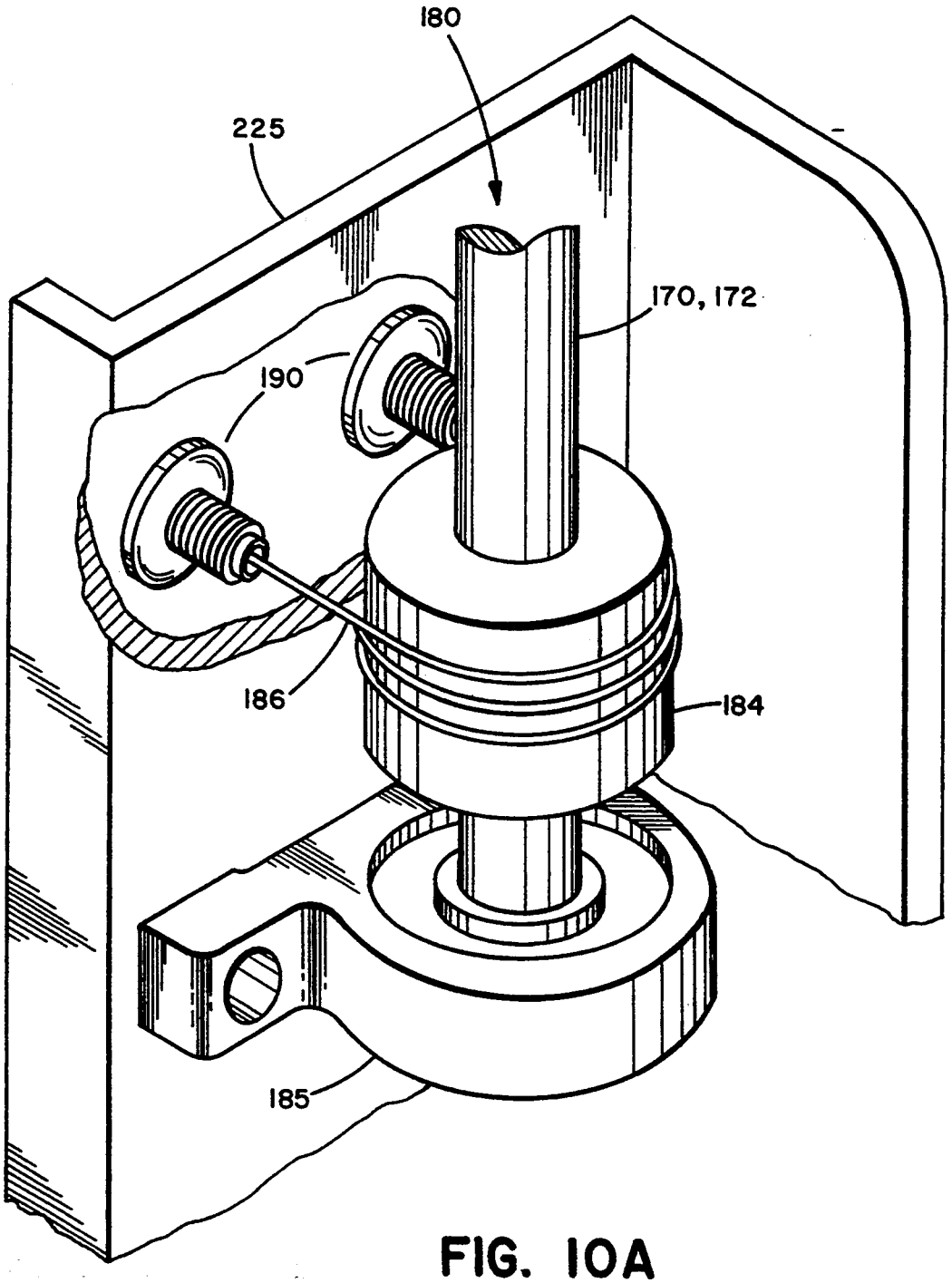
Figure 10B:
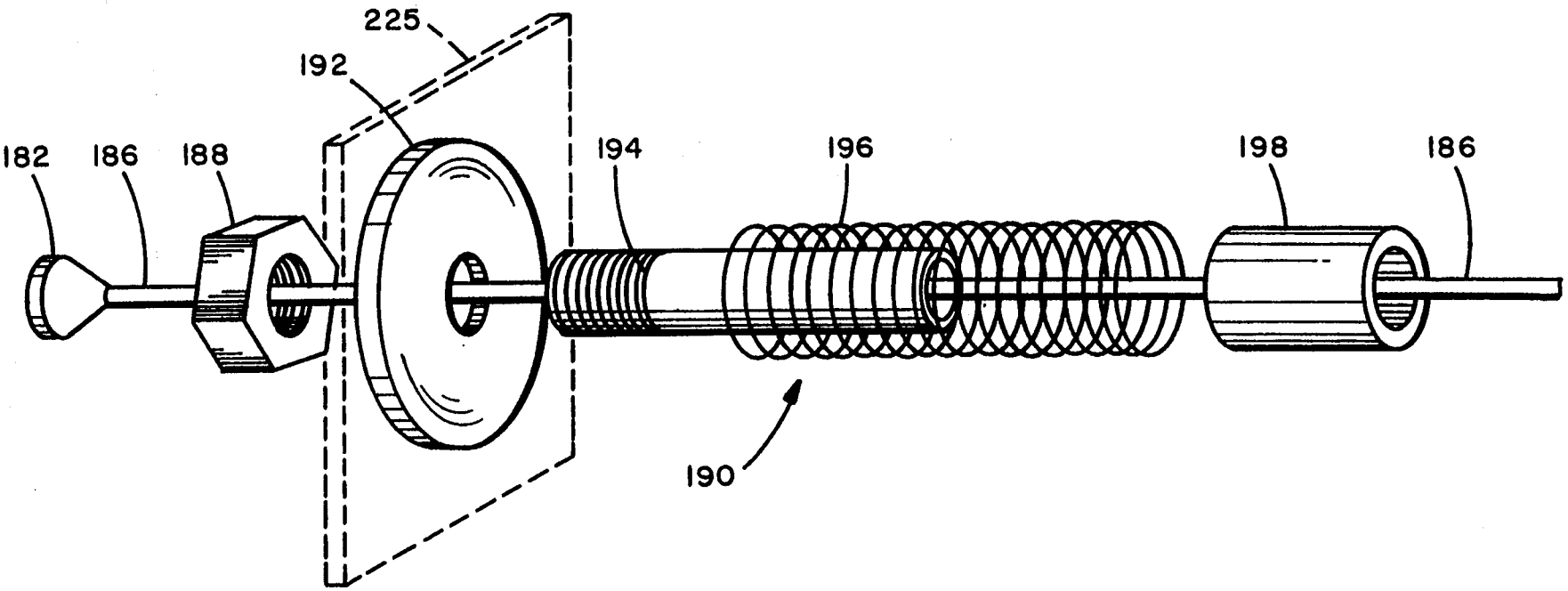
Figure 11:
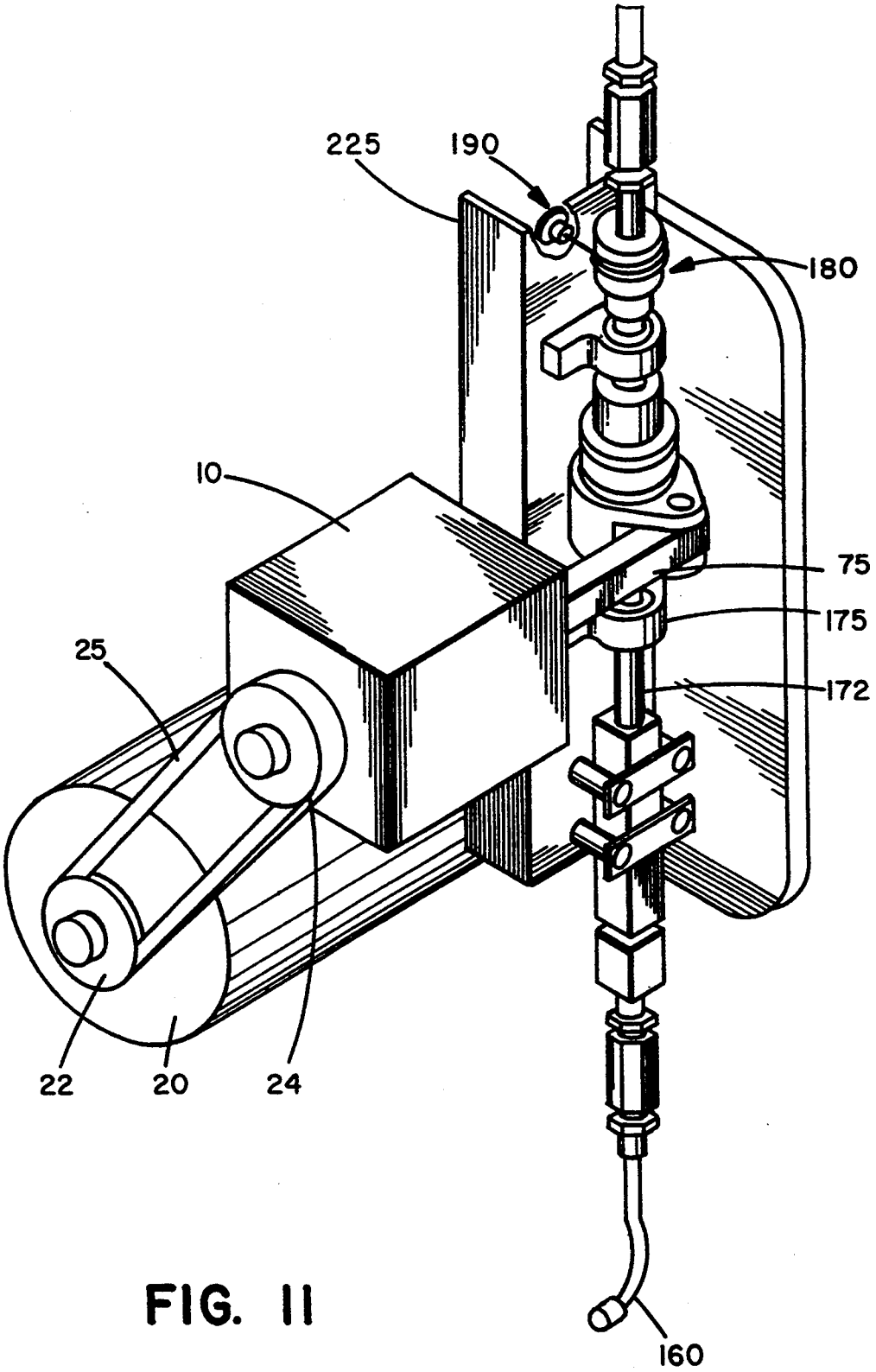

h) FIG. 8*a* and *b* show plan view and cross section of the diamond or like material orifice of the liquid jet nozzle.

i) FIG. 9*a* and *b* show front and side view path of the liquid jet as the jet nozzle is lowered into the cut.

j) FIG. 10(*a*) is a perspective view of the cable tensioning means for adjusting the balance of the balanced oscillator which is accomplished by pretensioning the oscillator or high pressure tubing.

k) FIG. 10(*b*) is a detailed perspective exploded assembly view of the of the tension adjusting means used at each end of the cable of FIG. 10(*a*).

l) FIG. 11 is a perspective view of the relationship between the balanced oscillator, the rigid pipe or the high pressure tube, the spring tensioning system, the waterjet nozzle and the multi-plane platform.

DETAILED DESCRIPTION OF THE PREFERRED EMBODIMENT

Figure 1:
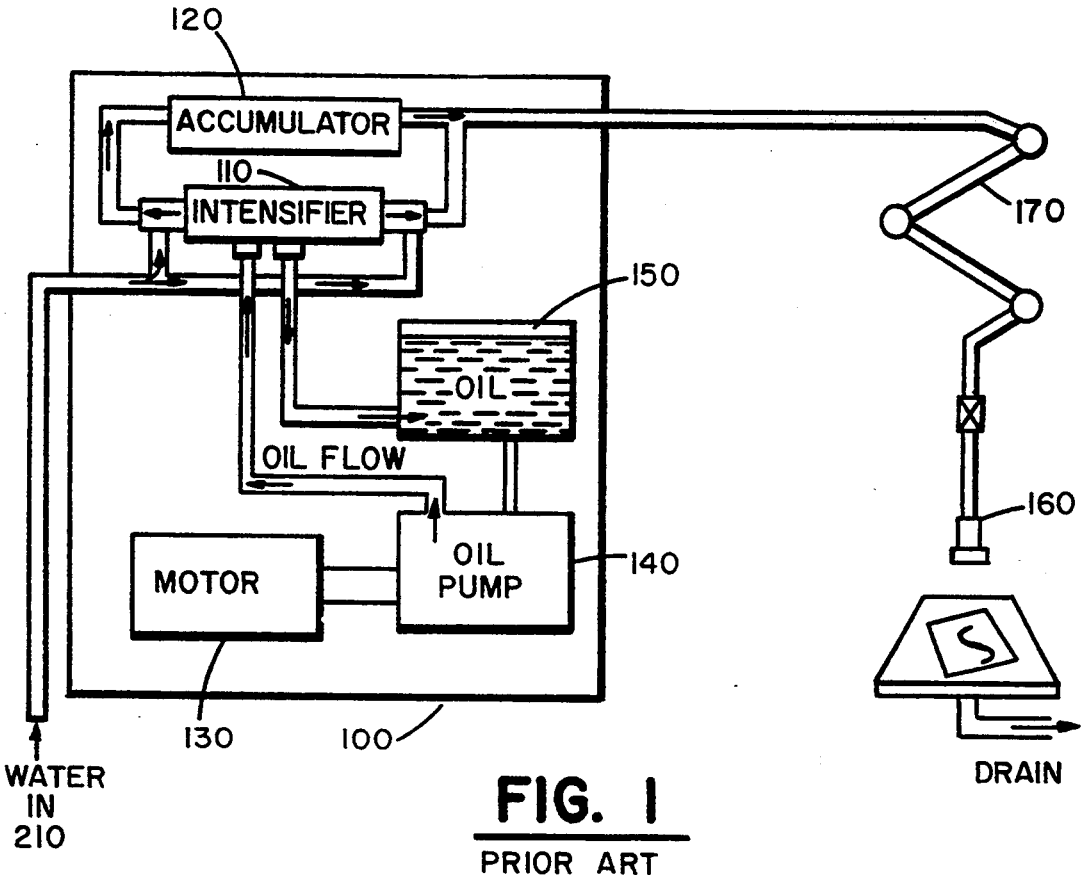
FIG. 1 PRIOR ART
FIG. 1 is a prior art block diagram illustrating the principle of high pressure liquid jet cutting system.

As shown in the drawings wherein like numerals represent like parts throughout the several views, there is generally disclosed in FIG. 1 the principle of liquid jet cutting systems which cut a material by fine stream of liquid (with or without abrasives) under high pressure which is achieved essentially by an intensifier subsystem 100 in which the intensifier 110 works in conjunction with an accumulator 120, a motor 130 and oil pump 140. The power unit 220 supplies power for the motor 130 which in turn drives the oil pump 140.

The power unit 220 also supplies power for the system generally. The liquid used for cutting such as water 210 should not be confused with the oil 150 used for the intensifier 110. The oil 150 in intensifier 110 is always recycled whereas the cutting jet liquid 210 is often recycled. Its the cutting jet liquid that exits the orifice 162 of nozzle 160 under high pressure. The nozzle 160 is connected to the intensifier subsystem 100 via a flexible, extendible hose 170.

Figure 2:
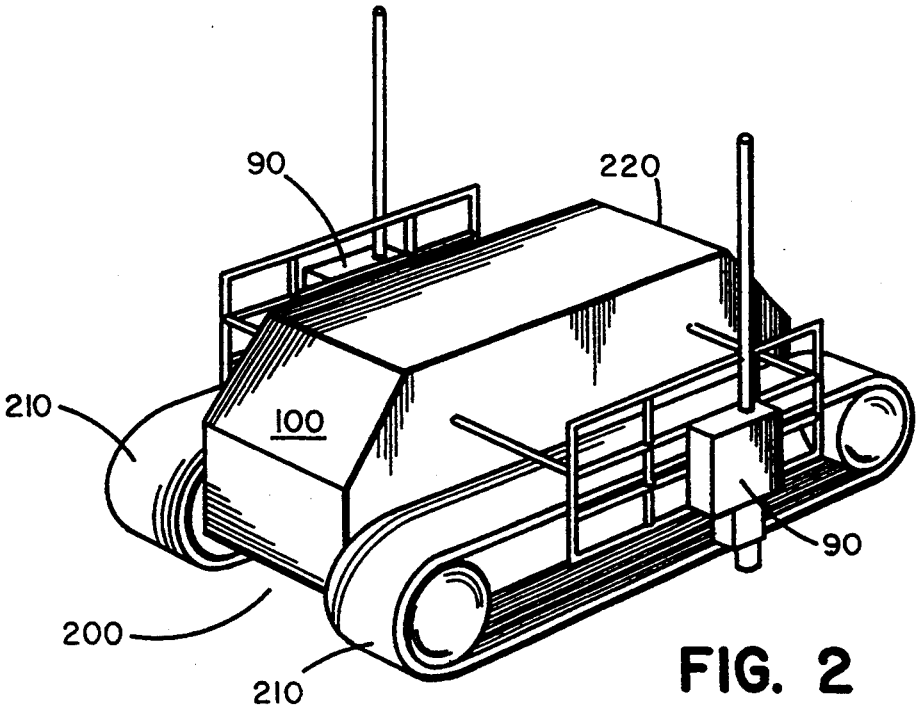
FIG. 2 is a perspective view of the programmable balanced oscillator liquid jet with rise and fall cutting system of this invention with two water jets powered by a single power unit and transported on a common crawler system.

As shown in FIG. 2 perspective the inventor for reasons of cost effectiveness recommends that each system 200 share a single power unit 220 mounted on a pair of crawlers 210 with two liquid jet cutting systems 100 notwithstanding the fact that the power 220 in the system 200 may not be enough to run both liquid jet cutting systems concurrently.

An essential and novel feature of this invention is the balanced oscillator which oscillates the nozzle 160 such that the dwell time at each end is equal and consequently the finish on both sides of the cut is equally smooth and symmetrical. This may also be adjusted with an unequal dwell time to compensate for some special quarry conditions. The balanced oscillator 10 is mounted on the mobile unit 210.

Figure 3:
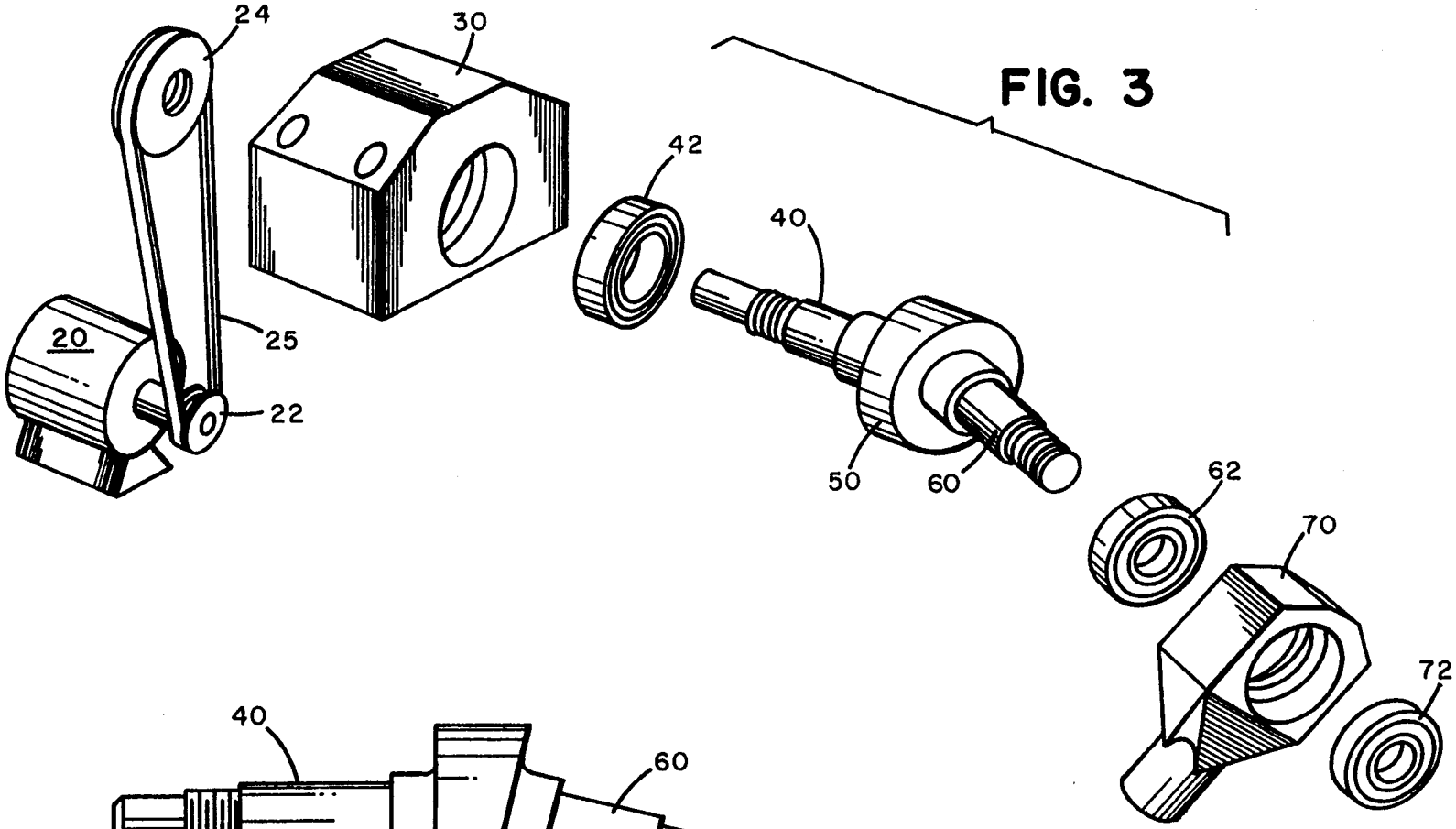
FIG. 3 is an exploded view of the various parts forming the balanced oscillator of this invention.
Figure 4:
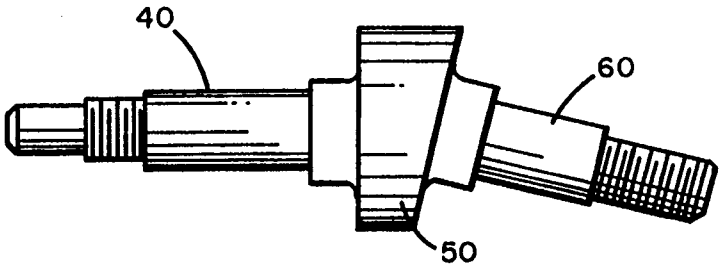
FIG. 4 is a plan view of the bent shaft used in the balanced oscillator of this invention, e)
Figure 5:
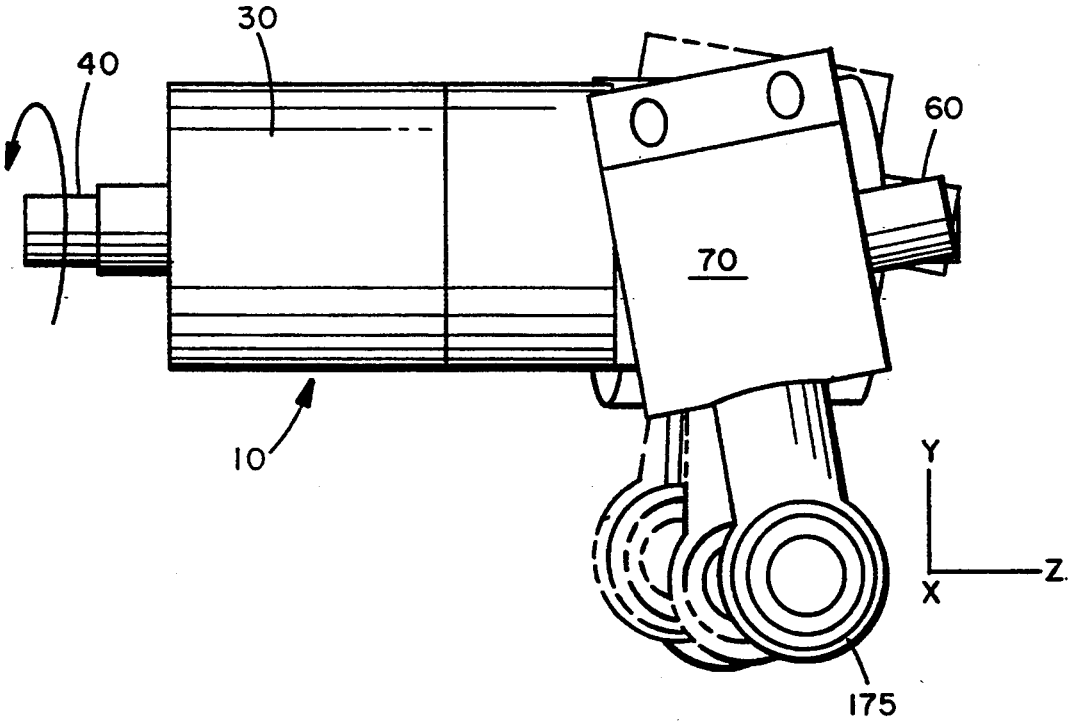
FIG. 5 is a plan view of the assembled balanced oscillator showing how the rotary motion of the motor at the input is translated to oscillating motion of the water jet at the output.

An exploded view of the oscillator is shown in FIG. 3. An essential component of the balanced oscillator 10 is a bent shaft 50 shown in FIG. 4 which in turn comprises a drive shaft 40 and a cam shaft 60. The drive shaft 40 is housed in drive housing 30 and the cam shaft 60 is housed in cam housing 70. The oscillator 50 comprises four primary parts drive housing 30, drive shaft 40, camshaft 60 and cam housing 70.

The drive shaft is driven by a motor 20 via a pair of pulleys 22 and 24 coupled by a belt 25. The balanced oscillator subsystem also includes accessories 42, 62 and 72 for proper assembly. The housing 70 also has a horizontal linkage 75 which interfaces linkage 175 between oscillator 10 and rigid pipe, which in turn is interfaced to high pressure tubing 172 and which in turn is connected to nozzle 160.

The center line of the drive shaft intersects with the center line of the cam housing. The drive housing is fixed to the frame and the cam housing is free to move to and fro but not rotate. Thus the rotary motion at the drive shaft 40 is converted into an oscillating motion at the nozzle receptacle 75.

The drive housing 30 and cam housing 70 are similar except that the cam housing 70 has threads inside to match the threads on the rod end of cam shaft 60. Both housings drive housing 30 and cam housing 70 have a space in the middle to locate a grease fitting and reservoir for grease to cool the pair of angular contact bearings.

Figure 6:
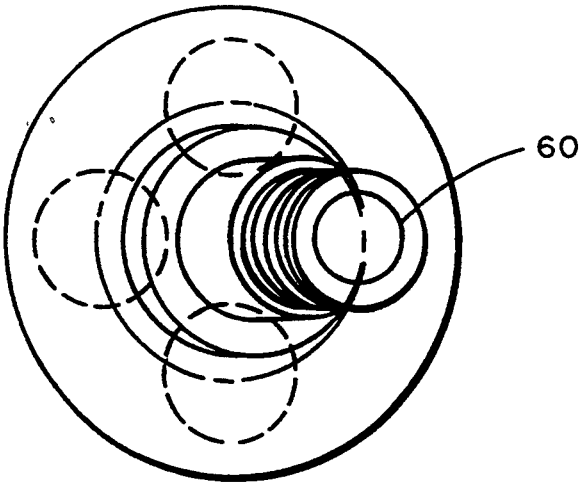
FIG. 6 shows the movement of the bent shaft of the balanced oscillator of this invention in more detail.

FIG. 6 shows the movement of the bent shaft 50 when viewed from the cam shaft end of the rod. This motion is still circulatory. However the motion of the housing 70 is oscillatory because the housing is free to move to and fro but not free to rotate. The rod end 60 moves back and forth a fixed distance as a function of the length of the rod. Thus by connecting a perpendicular linkage 80 to the rod end the rotary motion at the drive end is converted into a linear or angular displacement.

Figure 7:
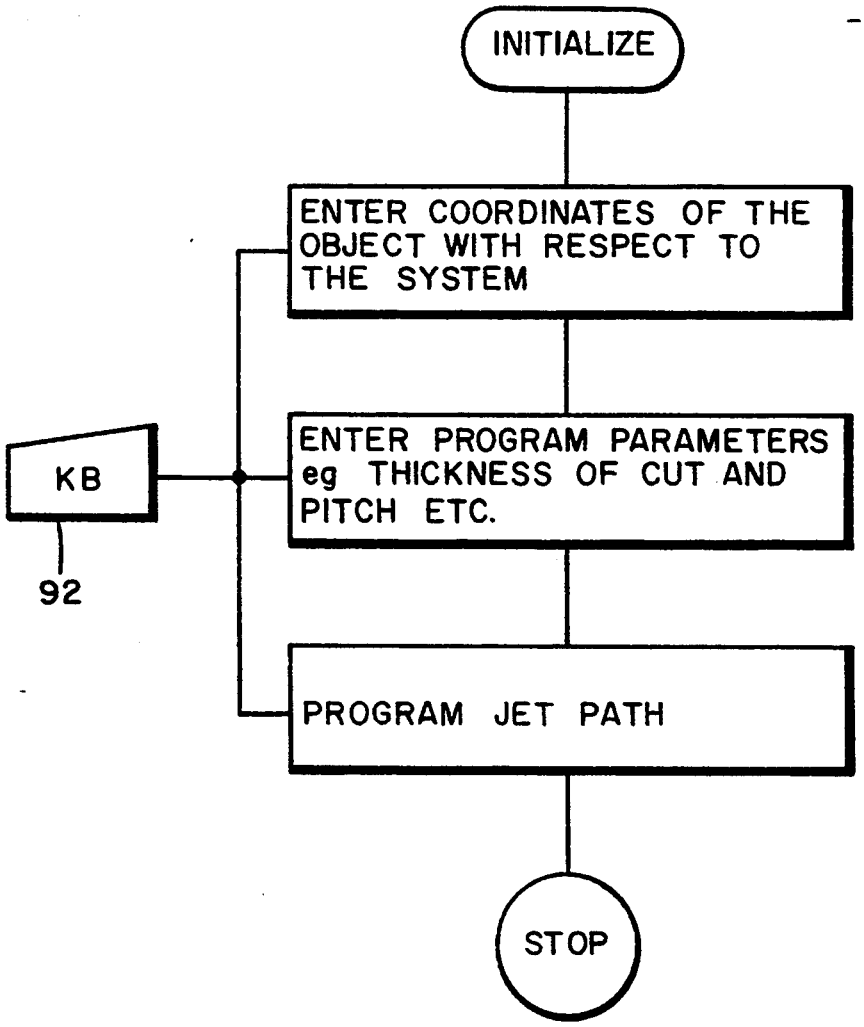
FIG. 7 shows a flow chart of the computer controlled algorithm used in the programming a cut in this system.

FIG. 7 shows a flow chart of the macro level steps involved in the programming and operation of the system.

Figure 8B:
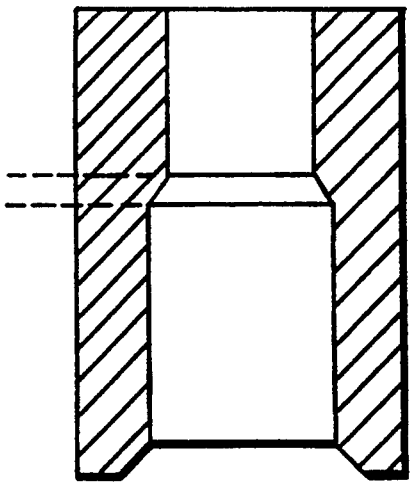

FIG. 8 A shows the plan view of the sapphire orifice 162 of nozzle 160. Similarly FIG. 8 B shows cross section of the sapphire orifice 162 of nozzle 160 of this invention.

FIG. 9 A shows the front view of the path of the liquid jet as the jet nozzle 160 is lowered under the control of the program for the desired cut. In this figure X is the pitch of the cut and C is the thickness of the cut.

FIG. 9 B shows the side view of the path of the liquid jet as the nozzle 160 is lowered under the control of the program for the desired cut.

FIG. 10(*a*) is a perspective view of the cable tensioning means for adjusting the balance of the balanced oscillator which is accomplished by pretensioning the oscillator rigid tube 172 or high pressure tubing 170. The intention of this device is to pretension the oscillator or high pressure tubing so as to alter the position and/or dwell of the nozzle as it moves to and fro.

It essentially comprises a cable 186 a few turns of which are wrapped around the rigid oscillator tubing 172 or the high pressure liquid jet tubing 170 via a hub 184. Each end of the cable 180 terminates in a spring tension assembly 190, which is shown in greater detail in FIG. 10(*b*). While bottom end of the tube 170 or 172 terminates in or carries the nozzle 160, the top end is anchored to the common platform 225 via a pillor block bearing housing 185.

FIG. 10(*b*) is a detailed perspective exploded assembly view of the of the tension adjusting means 190 used at each end of the cable 186 of FIG. 10(*a*). This tension adjusting means at each end comprises the cable 186 terminating in a cable stop 182, followed by a tensioning nut 188, a washer 192, a threaded shaft with hole in the center 194, a spring 196, and a hard bushing 198. This tension adjusting assembly 190 is anchored to the common platform 225.

FIG. 11 is a perspective view of the relationship between the balanced oscillator, the rigid pipe or the high pressure tube, the spring tensioning system, the waterjet nozzle and the multi-plane platform. As can be clearly seen from FIG. 11 the oscillator 10, the pillor block bearing housing 185 of FIG. 10 and the tension adjusting assembly 190 at each end of the cable 186 are all anchored to the common multi-plane platform 225 which does not travel down in the stone. The nozzle 160 however does travel down the stone cut path. Thus the oscillator 10 oscillates the water jet remotely via high pressure tubing 170 or a rigid pipe 172.

OPERATION

The oscillator assembly moves up and down (also known as rise and fall) the distance determined by the positioning of the top and bottom proximity sensors (not shown). This motion is repeated over and over again unless in the unlikely event the oscillator or some other related component jams.

In the event an obstruction that causes the oscillator or the rise and fall to slow down or stop, the computer 95 senses a change of speed and shuts down. This is a very effective safety feature for the unexpected in the quarries.

In the preferred embodiment the inventors used 16 feet travel for rise and fall at a variable speed of approximately 40 feet per minute. But these limitations can be easily extended by design.

The rise and fall is motor assisted and counter balanced to reduce the strength of the system in the downward direction in order to protect the nozzle and the high pressure fittings.

The horizontal travel (also known as indexer) moves a predetermined amount setable via keyboard 92 connected to computer 95 is normally activated when the bottom proximity sensor is activated. It is also possible to index at top only or top and bottom both.

The oscillator speed is function of many variables including the rise and fall, the grain of the stone being cut. In the preferred embodiment the oscillator speed was 1200 cycles per minute.

The following steps are typical of a cycle, a) The oscillator assembly falls until the lower proximity switch is activated, b) Machine indexes or travels horizontally c) The oscillator assembly rises irrespective of the status of the indexing d) Eventually the oscillator assembly activates the top proximity switch and e) the oscillator assembly falls again to repeat the cycle, To use this system the inventor recommends the following steps:

a) Initialize the system b) Position the system at proper coordinates.

c) Program the coordinates of the location of the system d) Program the coordinates of the object to be cut.

e) Define and enter the thickness of the cut.

f) Define and enter the pitch (the distance between the zig zags). It should be noted that the optimum pitch is defined by the stone structure and its strength in tension. As a rule of thumb the larger the grain structure the higher the pitch.

g) Enter the desired oscillator speed via keyboard 92 or another equivalent input device.

h) Program the nozzle jet cutting tool path or load in the program from a preprogrammed computer readable media.

i) Push auto cycle start and oscillator on when ready.

j) Monitor the control panel for any problems.

k) Stop the system if it does not automatically stop after a malfunction or upon completion of the curl.

l) Repeat steps b through h for the next cut.

The inventor has given a non-limiting description of the concept. Many changes may be made to this design without deviating from the spirit of the concept of this invention. Examples of such contemplated variations include the following.

a) The crawler may be obviated or substituted by a mobile unit.

b) A single mobile and power unit may use one or more liquid jets.

c) The cutting methodology and embodiment may be adapted for mining or for cutting other materials.

d) A different permutation and combination of the parts disclosed here may be used to fine tune the cut.

e) Additional features such as a automatic display, automatic safety features may be incorporated.

f) The programming may be further simplified such that it is user programmable.

g) Instead of the sapphire or the diamond the orifice may be comprised of diamond based or equivalent hardened material.

h) Other changes such as aesthetic and substitution of newer materials as they become available which substantially perform the same function in substantially the same manner with substantially the same result without deviating from the spirit of this invention.

Following is a listing of the components used in this embodiment arranged in ascending order of the reference numerals for ready reference of the reader.

10=Balanced oscillator
20=Oscillator Motor
25=Oscillator Motor Coupling Belt
30=Drive housing
40=Drive shaft 50=Bent shaft
60=Cam shaft
70=Cam housing
75=Horizontal linkage
80=Perpendicular Linkage
90=Control Panel
92=Keyboard or other input device
95=Computer with CPU
100=Intensifier Subsystem
110=Intensifier
120=Accumulator
130=Intensifier Motor
140=Oil Pump
150=Oil Reservoir
160=Nozzle
162=Sapphire diamond, or like material orifice
170=Flexible extendible hose/High Pressure Tube
172=Rigid Pipe oscillated by oscillator 10
175=Linkage between oscillator and rigid pipe
180=Oscillator Balance Adjusting Assembly generally
182=Cable Stop
184=Hub over rigid pipe or high pressure tube
185=Pillor Block Bearing Housing
186=Cable
188=Tensioning Nut
190=Spring Tensioning Assembly Generally
192=Washer
194=Threaded Shaft with Hole in the center
196=Spring
198=Hard Bushing
200=Programmable Oscillating Liquid Jet Cutting System of this invention generally.
210=Mobile unit
220=Power Unit
225=Multi-Plane Common Platform While this invention has been described with reference to illustrative embodiments, this description is not intended to be construed in a limiting sense. Various modifications and combinations of the illustrative embodiments as well as other embodiments of the invention will be apparent to person skilled in the art upon reference to this description. It is therefore contemplated that the appended claims cover any such modifications, embodiments as fall within the true scope of the invention.

The Inventor claims:

1. A balanced oscillator for oscillating the liquid jet in a programmable oscillating liquid jet cutting system particularly adopted for cutting granite on-site at quarries comprising:

a) a frame
b) a cam housing mounted on said frame;
c) a bent cam shaft mounted in said cam housing;
d) a drive housing mounted on said frame and connected to said cam housing;
e) a drive shaft mounted in said drive housing; and
f) a means for adjusting the balance of the balanced oscillator;
g) the centerline of said drive shaft intersects with the centerline of said cam housing;
h) the drive housing is fixed to said frame;
i) said cam housing is free to move to and fro but not rotate;
j) said cam shaft comprises a first threaded rod end;
k) said drive shaft comprises a second threaded rod end;
l) said cam housing has threads inside to match the threads on said first threaded rod end of said cam shaft; and
m) said means for adjusting the balance comprises a spring tensioning means.

2. A balanced oscillator for oscillating the liquid jet in a programmable oscillating liquid jet cutting system particularly adopted for cutting granite on-site at quarries comprising:

a) a frame
b) a cam housing mounted on said frame;
c) a bent cam shaft mounted in said cam housing;
d) a drive housing mounted on said frame and connected to said cam housing;
e) a drive shaft mounted in said drive housing;
f) a means for adjusting the balance of the balanced oscillator;
g) the centerline of said drive shaft intersects with the centerline of said cam housing;
h) the drive housing is fixed to said frame;
i) said cam housing is free to move to and fro but not rotate;
j) said cam shaft comprises a first threaded rod end;
k) said drive shaft comprises a second threaded rod end;
l) said cam housing has threads inside to match the threads on said first threaded rod end of said cam shaft;
m) said means for adjusting the balance comprises a spring tensioning means;
n) said drive shaft is driven by a motor via a pair of pulleys coupled by a belt;
o) said cam housing includes a first pair of angular contact bearings;
p) said drive housing a includes a second pair of angular contact bearings;
q) said cam housing includes a first grease fitting accessory and a first grease reservoir for cooling said first pair of angular contact bearings; and
r) said drive housing includes a second grease fitting accessory and a second grease reservoir for cooling said second angular contact bearings.

3. A balanced oscillator for oscillating the liquid jet in a programmable oscillating liquid jet cutting system particularly adopted for cutting granite on-site at quarries comprising:

a) a frame
b) a cam housing mounted on said frame;
c) a bent cam shaft mounted in said cam housing;
d) a drive housing mounted on said frame and connected to said cam housing;
e) a drive shaft mounted in said drive housing;
f) a means for adjusting the balance of the balanced oscillator;
g) the centerline of said drive shaft intersects with the centerline of said cam housing;
h) the drive housing is fixed to said frame;
i) said cam housing is free to move to and fro but not rotate;
j) said cam shaft comprises a first threaded rod end;
k) said drive shaft comprises a second threaded rod end;
l) said cam housing has threads inside to match the threads on said first threaded rod end of said cam shaft;
m) said drive shaft is driven by a motor via a pair of pulleys coupled by a belt;

n) said cam housing includes a first pair of angular contact bearings;

o) said drive housing a includes a second pair of angular contact bearings;

p) said cam housing includes a first grease fitting accessory and a first grease reservoir for cooling said first pair of angular contact bearings; and q) said drive housing includes a second grease fitting accessory and a second grease reservoir for cooling said second angular contact bearings.

4. A balanced oscillator for oscillating the liquid jet in a programmable oscillating liquid jet cutting system particularly adopted for cutting granite on-site at quarries comprising:

a) a frame b) a bent shaft which in turn comprises a drive shaft and a cam shaft, mounted on said frame;

c) a cam housing mounted on said frame over said cam shaft;

d) a drive housing mounted on said frame over and around said drive shaft and connected to said cam housing;

f) the centerline of said drive shaft intersects with the centerline of said cam housing;

g) the drive housing is fixed to said frame;

h) said cam housing is free to move to and fro but not rotate;

i) said cam shaft comprises a first threaded rod end;

j) said drive shaft comprises a second threaded rod end;

k) said cam housing has threads inside to match the threads on said first threaded rod end of said cam shaft;

l) said drive shaft is driven by a motor via a pair of pulleys coupled by a belt;

m) said cam housing includes a first pair of angular contact bearings;

n) said drive housing a includes a second pair of angular contact bearings;

o) said cam housing includes a first grease fitting accessory and a first grease reservoir for cooling said first pair of angular contact bearings; and p) said drive housing includes a second grease fitting accessory and a second grease reservoir for cooling said second angular contact bearings.

5. A balanced oscillator for oscillating the liquid jet in a programmable oscillating liquid jet cutting system particularly adopted for cutting granite on-site at quarries comprising:

a) a frame b) a bent shaft which in turn comprises a drive shaft and a cam shaft, mounted on said frame;

c) a cam housing mounted on said frame over said cam shaft;

d) a drive housing mounted on said frame over and around said drive shaft and connected to said cam housing;

f) the centerline of said drive shaft intersects with the centerline of said cam housing;

g) the drive housing is fixed to said frame;

h) said cam housing is free to move to and fro but not rotate;

i) said cam shaft comprises a first threaded rod end;

j) said drive shaft comprises a second threaded rod end;

k) said cam housing has threads inside to match the threads on said first threaded rod end of said cam shaft;

l) the centerline of said drive shaft intersects with the centerline of said cam housing;

m) the drive housing is fixed to said frame;

n) said cam housing is free to move to and fro but not rotate;

o) said cam shaft comprises a first threaded rod end;

p) said drive shaft comprises a second threaded rod end;

q) said cam housing has threads inside to match the threads on said first threaded rod end of said cam shaft;

r) said drive shaft is driven by a motor via a pair of pulleys coupled by a belt;

s) said cam housing includes a first pair of angular contact bearings;

t) said drive housing a includes a second pair of angular contact bearings;

u) said cam housing includes a first grease fitting accessory and a first grease reservoir for cooling said first pair of angular contact bearings; and v) said drive housing includes a second grease fitting accessory and a second grease reservoir for cooling said second angular contact bearings.

* * * * *